US010907465B2

(12) United States Patent
Hay et al.

(10) Patent No.: US 10,907,465 B2
(45) Date of Patent: Feb. 2, 2021

(54) CLOSED-LOOP DRILLING PARAMETER CONTROL

(71) Applicant: Halliburton Energy Services, Inc., Houston, TX (US)

(72) Inventors: Richard Thomas Hay, Spring, TX (US); Daniel Winslow, Spring, TX (US); Neelesh Deolalikar, Houston, TX (US); Michael Strachan, Conroe, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 307 days.

(21) Appl. No.: 14/765,688

(22) PCT Filed: Dec. 20, 2013

(86) PCT No.: PCT/US2013/076802

§ 371 (c)(1),
(2) Date: Aug. 4, 2015

(87) PCT Pub. No.: WO2015/094320

PCT Pub. Date: Jun. 25, 2015

(65) Prior Publication Data

US 2015/0369030 A1 Dec. 24, 2015

(51) Int. Cl.
*E21B 44/00* (2006.01)
*E21B 44/04* (2006.01)
(Continued)

(52) U.S. Cl.
CPC ..... *E21B 44/04* (2013.01); *E21B 3/00* (2013.01); *E21B 4/02* (2013.01); *E21B 21/08* (2013.01);
(Continued)

(58) Field of Classification Search
CPC ..... E21B 47/12; E21B 44/00
See application file for complete search history.

(56) References Cited

U.S. PATENT DOCUMENTS 5,358,058 A * 10/1994 Edlund ..... E21B 44/00 175/24
6,273,189 B1 8/2001 Gissler et al.
(Continued)

FOREIGN PATENT DOCUMENTS

EA 201070263 A1 8/2010
EP 0857249 B1 4/2006
(Continued)

OTHER PUBLICATIONS

International Preliminary Report on Patentability issued in related Application No. PCT/US2013/076802, dated Jun. 30, 2016 (14 pages).
(Continued)

*Primary Examiner* — Robert E Fuller
*Assistant Examiner* — Lamia Quaim
(74) *Attorney, Agent, or Firm* — Benjamin Ford; Baker Botts L.L.P.

(57) ABSTRACT

An example method for control of a drilling assembly includes receiving measurement data from at least one sensor coupled to an element of the drilling assembly positioned in a formation. An operating constraint for at least a portion of the drilling assembly may be determined based, at least in part, on a model of the formation and a set of offset data. A control signal may be generated to alter one or more drilling parameters of the drilling assembly based, at least in part, on the measurement data and the operating constraint. The control signal may be transmitted to a controllable element of the drilling assembly.

24 Claims, 9 Drawing Sheets

(51) Int. Cl.

| | |
|---|---|
| ***E21B 3/00*** | (2006.01) |
| ***E21B 4/02*** | (2006.01) |
| ***E21B 21/08*** | (2006.01) |
| *E21B 45/00* | (2006.01) |

(52) U.S. Cl.
CPC ..... *E21B 44/00* (2013.01); *E21B 44/005* (2013.01); *E21B 45/00* (2013.01)

(56) References Cited

U.S. PATENT DOCUMENTS

| | | | | |
|---|---|---|---|---|
| 6,516,898 | B1 | 2/2003 | Krueger | |
| 7,757,781 | B2 | 7/2010 | Hay et al. | |
| 2004/0256152 | A1* | 12/2004 | Dashevskiy | E21B 44/00 175/25 |
| 2005/0279532 | A1* | 12/2005 | Ballantyne | E21B 47/12 175/40 |
| 2006/0173625 | A1* | 8/2006 | Moran | E21B 44/00 702/9 |
| 2009/0201170 | A1 | 8/2009 | Reckmann et al. | |
| 2011/0174541 | A1 | 7/2011 | Strachan et al. | |
| 2011/0186353 | A1* | 8/2011 | Turner | E21B 44/00 175/40 |
| 2012/0024606 | A1 | 2/2012 | Pirovolou et al. | |
| 2012/0267169 | A1* | 10/2012 | Schwefe | E21B 47/024 175/45 |
| 2013/0092439 | A1* | 4/2013 | Mauldin | E21B 44/00 175/40 |
| 2013/0292176 | A1* | 11/2013 | Ekseth | E21B 7/067 175/24 |
| 2015/0088468 | A1* | 3/2015 | Hohl | E21B 41/00 703/2 |

FOREIGN PATENT DOCUMENTS

| | | | |
|---|---|---|---|
| RU | 2244117 | C2 | 1/2005 |
| RU | 2452855 | C2 | 6/2012 |
| RU | 2471980 | C2 | 1/2013 |
| SU | 1055863 | A1 | 11/1983 |
| WO | 2013101984 | A2 | 7/2013 |

OTHER PUBLICATIONS

Office Action issued in related RU Application No. 2016117319, dated May 19, 2017 (8 pages).
International Search Report and Written Opinion in related application PCT/US2013/076802, dated Sep. 24, 2014. 18 pages.

* cited by examiner

CLOSED-LOOP DRILLING PARAMETER CONTROL

CROSS-REFERENCE TO RELATED APPLICATION

The present application is a U.S. National Stage Application of International Application No. PCT/US2013/076802, filed Dec. 20, 2013, which is incorporated herein by reference in its entirety for all purposes.

BACKGROUND

Hydrocarbons, such as oil and gas, are commonly obtained from subterranean formations that may be located onshore or offshore. In most cases, the formations are located thousands of feet below the surface, and a wellbore must intersect the formation before the hydrocarbon can be recovered. As well drilling operations become more complex, and hydrocarbon reservoirs correspondingly become more difficult to reach, the need to precisely locate a drilling assembly—both vertically and horizontally—in a formation increases. Drilling the boreholes to reach the formations of interest within the mechanical and operational limits of the drilling system yet still accurately and efficiently is difficult but important to the profitability of the drilling operation.

FIGURES

Some specific exemplary embodiments of the disclosure may be understood by referring, in part, to the following description and the accompanying drawings.

Figure 1:
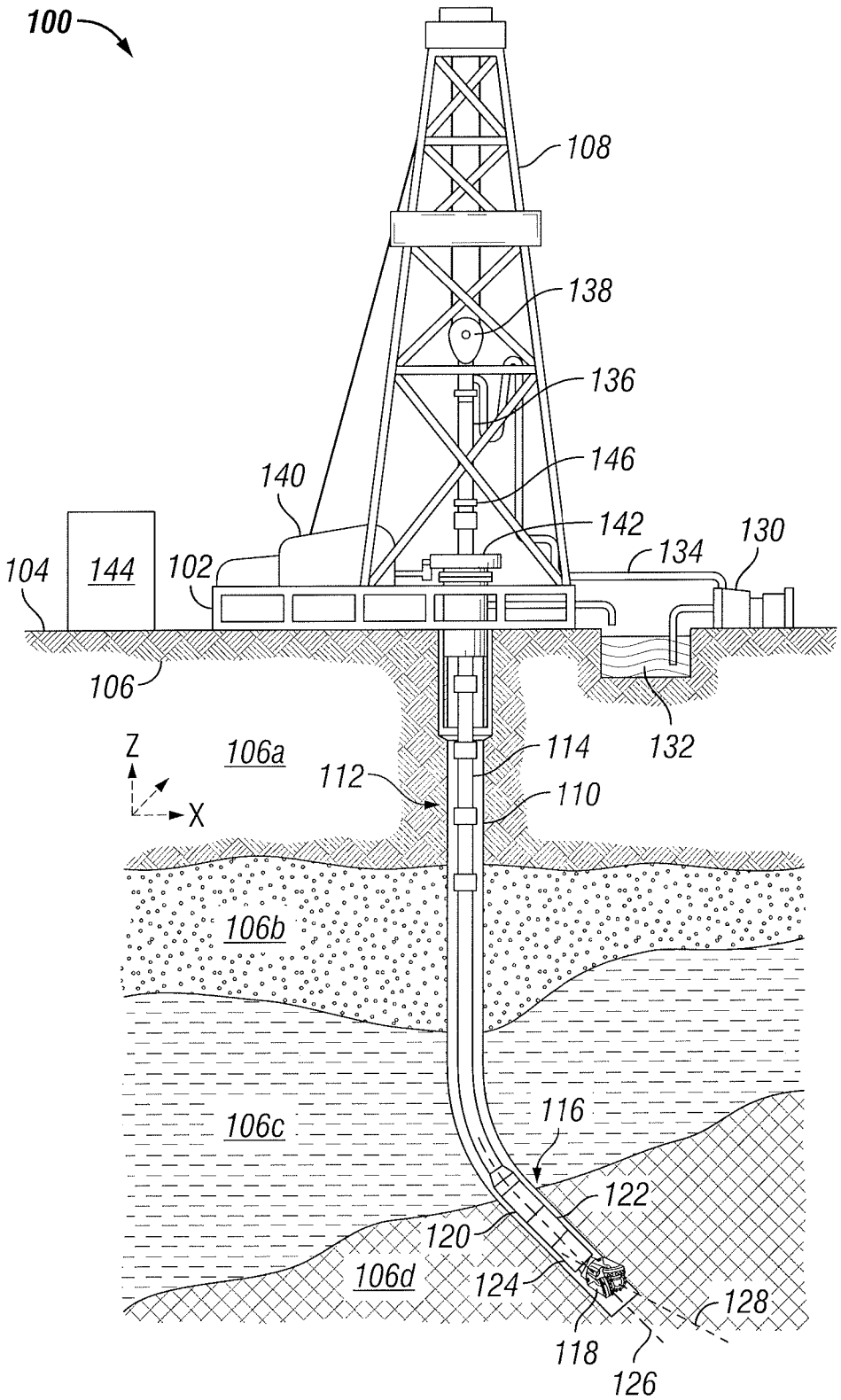
FIG. 1 is a diagram of an example drilling system, according to aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more secondary storage devices such as disk drives, solid state drives such as Flash RAM drives, Cloud Storage Devices on a network, one or more network ports for communication with external devices as well as various input and output (I/O) devices, such as a keyboard, a mouse, and a video display. The information handling system may also include one or more buses operable to transmit communications between the various hardware components. It may also include one or more interface units capable of transmitting one or more signals to a controller, actuator, or like device.

For the purposes of this disclosure, computer-readable media may include any instrumentality or aggregation of instrumentalities that may retain data and/or instructions for a period of time. Computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

Illustrative embodiments of the present disclosure are described in detail herein. In the interest of clarity, not all features of an actual implementation may be described in this specification. It will of course be appreciated that in the development of any such actual embodiment, numerous implementation-specific decisions are made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure.

To facilitate a better understanding of the present disclosure, the following examples of certain embodiments are given. In no way should the following examples be read to limit, or define, the scope of the disclosure. Embodiments of the present disclosure may be applicable to horizontal, vertical, deviated, or otherwise nonlinear wellbores in any type of subterranean formation. Embodiments may be applicable to injection wells as well as production wells, including hydrocarbon wells. Embodiments may be implemented using a tool that is made suitable for testing, retrieval and sampling along sections of the formation. Embodiments may be implemented with tools that, for example, may be conveyed through a flow passage in tubular string or using a wireline, slickline, coiled tubing, downhole robot or the like.

The terms "couple" or "couples" as used herein are intended to mean either an indirect or a direct connection. Thus, if a first device couples to a second device, that connection may be through a direct connection or through an indirect mechanical or electrical connection via other devices and connections. Similarly, the term "communicatively coupled" as used herein is intended to mean either a direct or an indirect communication connection. Such connection may be a wired or wireless connection such as, for example, Ethernet or LAN. Such wired and wireless connections are well known to those of ordinary skill in the art and will therefore not be discussed in detail herein. Thus, if a first device communicatively couples to a second device, that connection may be through a direct connection, or through an indirect communication connection via other devices and connections.

Modern petroleum drilling and production operations demand information relating to parameters and conditions downhole. Several methods exist for downhole information collection, including logging-while-drilling ("LWD") and measurement-while-drilling ("MWD"). In LWD, data is typically collected during the drilling process, thereby avoiding any need to remove the drilling assembly to insert a wireline logging tool. LWD consequently allows the driller to make accurate real-time modifications or corrections to optimize performance while minimizing down time. MWD is the term for measuring conditions downhole concerning the movement and location of the drilling assembly while the drilling continues. LWD concentrates more on formation parameter measurement. While distinctions between MWD and LWD may exist, the terms MWD and LWD often are used interchangeably. For the purposes of this disclosure, the term LWD will be used with the understanding that this term encompasses both the collection of formation parameters and the collection of information relating to the movement and position of the drilling assembly.

FIG. 1 is a diagram of an example drilling system 100, according to aspects of the present disclosure. The drilling system 100 may comprise a drilling platform 102 positioned at the surface 104. In the embodiment shown, the surface 102 comprises the top of a formation 106 containing one or more rock strata or layers 106*a-d*. Although the surface 104 is shown as land in FIG. 1, the drilling platform 102 of some embodiments may be located at sea, in which case the surface 104 would be separated from the drilling platform 102 by a volume of water.

The drilling system 100 may include a rig 108 mounted on the drilling platform 102 and positioned above borehole 110 within the formation 106. In the embodiment shown, a drilling assembly 112 may be at least partially positioned within the borehole 110 and coupled to the rig 108. The drilling assembly 112 may comprise a drill string 114, a bottom hole assembly (BHA) 116, and a drill bit 118. The drill string 114 may comprise multiple drill pipe segments that are threadedly engaged. The BHA 116 may be coupled to the drill string 114, and the drill bit 118 may be coupled to the BHA 116.

The BHA 116 may include tools such as telemetry system 120 and LWD/MWD elements 122. The LWD/MWD elements 122 may comprise downhole instruments—including sensors, antennas, gravitometers, gyroscopes, magnetometers, inertial measurement units etc.—that may continuously or intermittently monitor downhole conditions and measure aspects of the borehole 110 and the formation 106 surrounding the borehole 110. The LWD/MWD elements 122 may further measure a tool face angle of the downhole elements, an angular position of the downhole elements with respect to the formation 106. Such measurements may be provided as measurement data to a processor (e.g. as described in FIG. 2 below). In certain embodiments, information generated by the LWD/MWD element 122 may be communicated as measurement data to the surface using telemetry system 120. The telemetry system 120 may provide communication with the surface over various channels, including wired and wireless communications channels as well as mud pulses through a drilling mud within the drilling assembly 112.

In certain embodiments, the BHA 116 may further comprise a steering assembly 124. The steering assembly 124 may be coupled to the drill bit 118 any may control the drilling direction of the drilling assembly 112 by controlling the angle and orientation of the drill bit with respect to the BHA 116 and/or the formation 106. The angle and orientation of the drill bit 112 may be controlled by the steering assembly 124, for example, by controlling a longitudinal axis 126 of the BHA 116 and a longitudinal axis 128 of the drill bit 118 together with respect to the formation 106 (e.g., a push-the-bit arrangement) or by controlling the longitudinal axis 128 of the drill bit 118 with respect to the longitudinal axis 126 of the BHA 116 (e.g., a point-the-bit arrangement.)

In the embodiments shown, the longitudinal axis 128 of the drill bit 118 is offset with respect to the longitudinal axis 126 of the BHA 116. The longitudinal axis 128 of the drill bit 118 may correspond to a drilling direction of the drilling assembly 112, i.e., the direction in which the drill bit 118 will cut into the formation 106 when rotated. Notably, the steering assembly 124 may be communicably coupled to the telemetry system 120 as well as one or more downhole and/or surface controllers that may determine and communicate to the steering assembly 128 the drilling direction for the drilling assembly 112.

A pump 130 located at the surface 104 may circulate drilling fluid at a pump rate (e.g., gallons per minutes) from a fluid reservoir 132, through a feed pipe 134 to kelly 136, downhole through the interior of drill string 114, through orifices in drill bit 118, back to the surface via the annulus around drill string 114, and into fluid reservoir 132. The drilling fluid transports cuttings from the borehole 110 into the reservoir 132 and aids in maintaining integrity or the borehole 110. The pump rate at the pump 130 may correspond to a downhole flow rate that varies from the pump rate due to fluid loss within the formation 106. In certain embodiments, the BHA 116 may comprise a fluid-driven downhole motor (not shown) that converts the flow of drilling fluid into rotational movement and torque that is used to drive the drill bit 118. The torque applied to the drill bit 118 by the downhole motor and the resulting rotation rate of the drill bit 118 may be based, at least in part, on the pump rate.

In certain embodiments, portions of the drilling assembly 112 may be suspended from the rig 108 by a hook assembly 138. The total force pulling down on the hook assembly 138 may be referred to as a hook load, characterized by the weight of the drill string 114, BHA 116, drill bit 118, and other downhole elements coupled to the drill string 114 less any force that reduces the weight, such as friction along the wall of the borehole 110 and buoyant forces on the drilling string 114 caused by its immersion in drilling fluid. When the drill bit 118 contacts the bottom of the formation 106, the formation 106 will offset some of the weight of the drilling assembly 112, and that offset may correspond to the weight-on-bit (WOB) of the drilling assembly 112. The hook assembly 138 may include a weight indicator that shows the amount of weight suspended from the hook 138 at a given time. In certain embodiments, the position of hook assembly 138 relative to the rig 108 and therefore the hook load and WOB may be varied using a winch 140 coupled to hook assembly 138.

The drilling system 100 may further comprise a top drive mechanism or rotary table 142. The drill string 114 may be at least partially within the rotary table 142, which may impart torque and rotation to the drill string 114 and cause the drill string 114 to rotate. Torque and rotation imparted on the drill string 114 may be transferred to the BHA 116 and the drill bit 118, causing both to rotate. The torque at the drill bit 118 caused by the rotary table 142 and/or the downhole motor described above may be referred to as the torque-on-bit (TOB) and the rate of rotation of the drill bit 118 may be expressed in rotations per minute (RPM). The rotation of the drill bit 118 may cause the drill bit 118 to engage with or drill into the formation 106 and extend the borehole 110. Other drilling assembly arrangements are possible.

In certain embodiments, the drilling system 100 may comprise a control unit 144 positioned at the surface 104. The control unit 144 may comprise an information handling system that implements a control system or a control algorithm for the drilling system 100. The control unit 144 may be communicably coupled to one or more controllable elements of the drilling system 100, including the pump 130, hook assembly 138/winch 140, LWD/MWD elements 122, rotary table 142, and steering assembly 124. Controllable elements may comprise elements of the drilling assembly 112 that respond to control signals from the control unit 114 to alter one or more drilling parameters of the drilling system 100, as will be described below. The control unit 144 may be communicably coupled to the surface controllable elements through wired or wireless connections, for example, and may be communicably coupled to the downhole controllable elements through the telemetry system 120 and a surface receiver 146. In certain embodiments, the control system or algorithm may cause the control unit 124 to generate and transmit control signals to one or more elements of the drilling system 100.

In certain embodiments, the control unit 144 may receive input data from the drilling system 100 and output control signals based, at least in part, on the input data. The input data may comprise measurement data or logging information from the BHA 116, including direct or indirect measurements of drilling parameters for the drilling assembly 112. Example drilling parameters include TOB, WOB, rotation rate of the drill bit, tool face angle, flow rate, etc. The control signals may be directed to the elements of the drilling system 100 communicably coupled to the control unit 144, or to actuators or other controllable mechanisms within those elements. In certain embodiments, some or all of the controllable elements of the drilling system 100 may include limited, integral control elements or processors that may receive a control signal from the control unit 144 and generate a specific command to the corresponding actuators or other controllable mechanisms.

The control signals output by the control unit may cause the elements of the drilling system 100 to which the control signals are directed to alter one or more drilling parameters. For example, a control signal directed to the pump 130 may cause the pump to alter the pump rate at which the drilling fluid is pumped into the drill string 114, which may in turn alter a flow rate through a downhole motor coupled to the drill bit 118 and the TOB and rate of rotation of the drill bit 118. A control signal directed to the hook assembly 138 may caused the hook assembly to alter the hook load by causing a winch 140 to bear more or less of the weight of the drilling assembly, which may alter both the WOB and TOB. A control signal directed to the rotary table 142 may cause the rotary table to alter the rotational speed and torque applied to the drill string 110, which may alter the TOB, the rate of rotation of the drill bit 118, and the tool face angle of the BHA 116. Although the control signals are described above with respect to surface elements of the drilling system 100, in certain embodiments, as will be described below, one or more downhole elements may receive control signals from a controller and alter one or more drilling parameters based on the control signal. Other control signal types would be appreciated by one of ordinary skill in the art in view of this disclosure.

Figure 2:
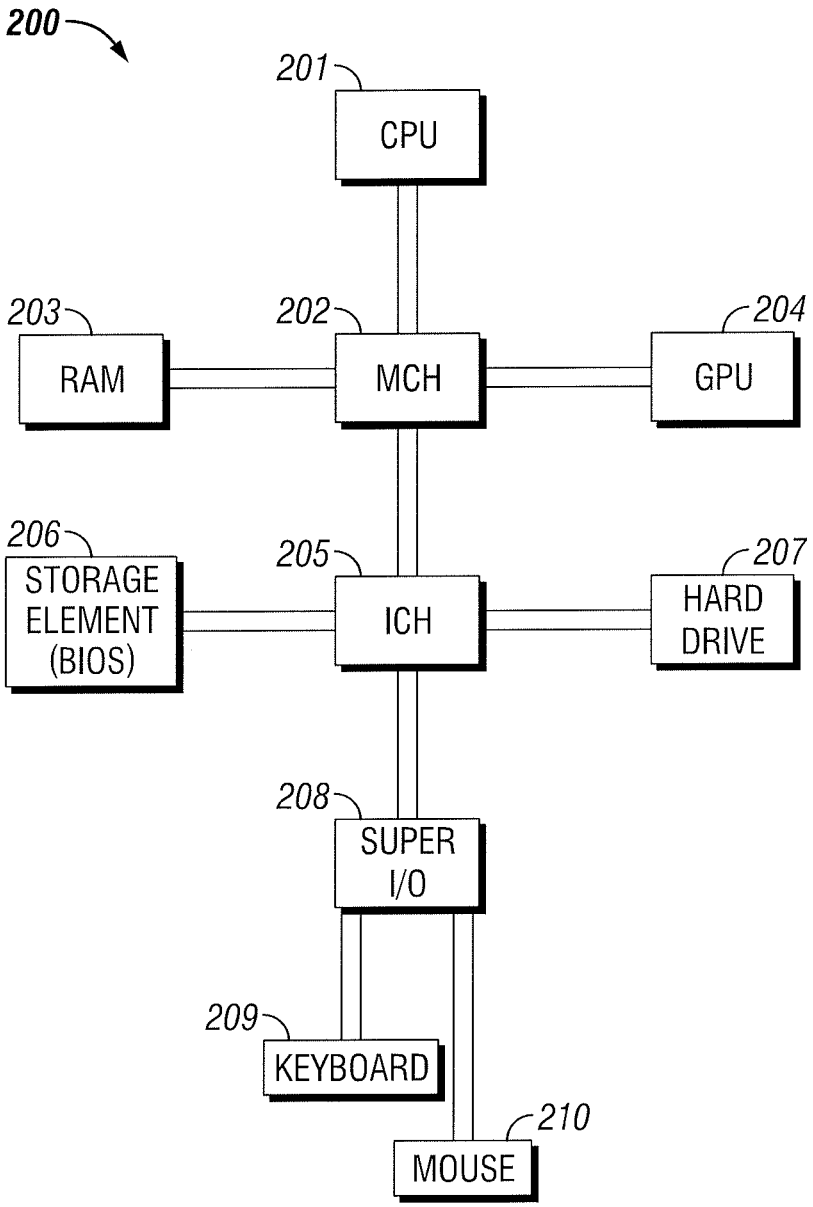
FIG. 2 is a diagram of an example information handling system, according to aspects of the present disclosure.

FIG. 2 is a block diagram showing an example information handling system 200, according to aspects of the present disclosure. Information handling system 200 may be used, for example, as part of a control system or unit for a drilling assembly, and may be located on the surface, downhole (e.g., in a borehole), or partially on the surface and partially downhole. For example, a drilling operator may interact with the information handling system 200 located at the surface to alter drilling parameters or to issue control signals to controllable elements of a drilling system communicably coupled to the information handling system 200. In other embodiments, the information handling system 200 may automatically generate control signals that cause elements of the drilling system to alter drilling parameters based, at least in part, on the input data received from the downhole elements, which will be described in detail below.

The information handling system 200 may comprise a processor or CPU 201 that is communicatively coupled to a memory controller hub or north bridge 202. Memory controller hub 202 may include a memory controller for directing information to or from various system memory components within the information handling system, such as RAM 203, storage element 206, and hard drive 207. The memory controller hub 202 may be coupled to RAM 203 and a graphics processing unit 204. Memory controller hub 202 may also be coupled to an I/O controller hub or south bridge 205. I/O hub 205 is coupled to storage elements of the computer system, including a storage element 206, which may comprise a flash ROM that includes a basic input/output system (BIOS) of the computer system. I/O hub 205 is also coupled to the hard drive 207 of the computer system. I/O hub 205 may also be coupled to a Super I/O chip 208, which is itself coupled to several of the I/O ports of the computer system, including keyboard 209 and mouse 210. The information handling system 200 further may be communicably coupled to one or more elements of a drilling system though the chip 208. The information handling system 200 may include software components that process input data and software components that generate commands or control signals based, at least in part, on the input data. As used herein, software or software components may comprise a set of instructions stored within a computer-readable medium that, when executed by a processor coupled to the computer-readable medium, cause the processor to perform certain actions.

According to aspects of the present disclosure, a control unit may determine or receive at least one operating constraint for a drilling assembly, and may generate and output control signals to the elements of the drilling assembly based, at least in part, on the operating constraint and the received input data. The operating constraints may comprise a range of drilling parameter values or a range of values related to the drilling parameters of the drilling assembly. Additionally, the operating constraints may be calculated to ensure that the drilling assembly stays within the physical and mechanical limits of the elements of the drilling assembly, or to optimize the operation of the drilling assembly or an element of the drilling assembly.

Figure 3:
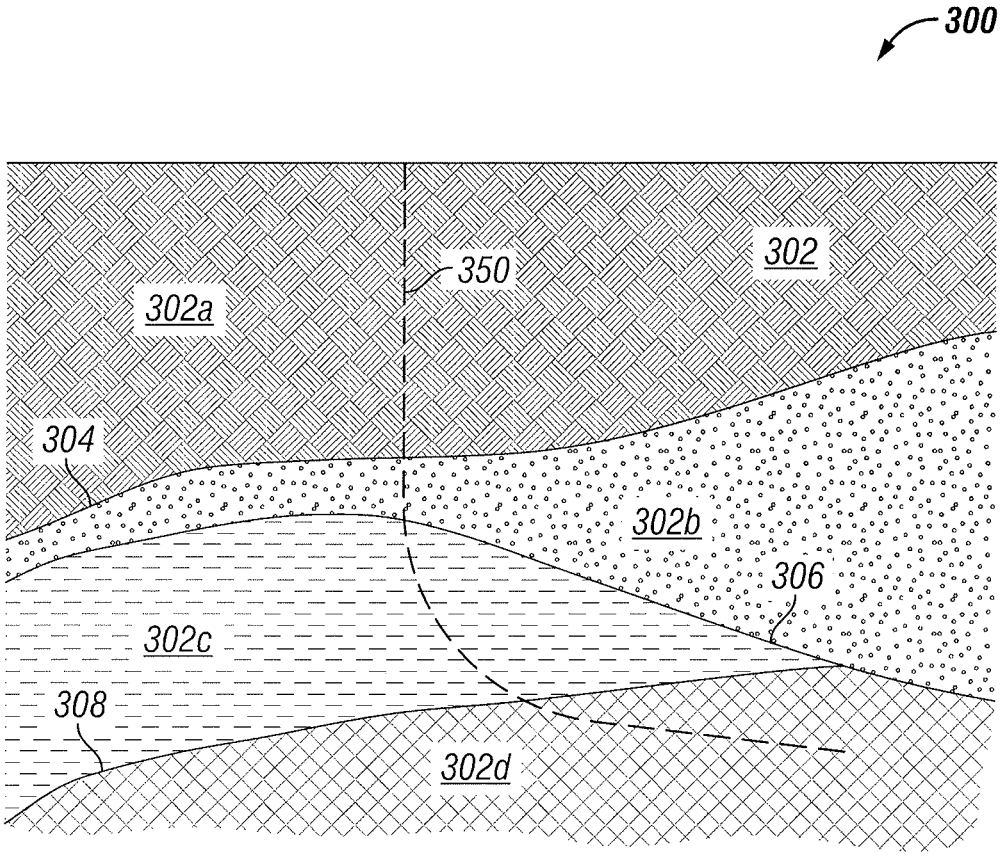
FIG. 3 is a block diagram of an example earth model, according to aspects of the present disclosure.

In certain embodiments, the operating constraints may be determined using at least one of an earth model and an offset data set. FIG. 3 is a diagram of an example earth model 300, according to aspects of the present disclosure. As can be seen, the earth model 300 comprises a formation 302 with strata 302*a-d*, each of which may contain a different type of rock with different mechanical and electromagnetic characteristics. The model 300 may identify the particular locations, orientations, rock-types, and characteristics of the formation strata 302*a-d*, including the locations of the boundaries 304-308 separating the strata 302*a-d*. In certain embodiments, the model 300 may be generated from on-site logging and survey data, including but not limited to acoustic, electromagnetic, and seismic survey data. Although the earth model 300 is shown as a visual representation for explanatory purposes, earth model 300 also may comprise a mathematical model.

In certain embodiments, a control unit may incorporate offset data into or use it in conjunction with the earth model 300 when determining operating constraints for the drilling assembly. As used herein, offset data may comprise actual data recorded from other drilling operations that correlates rock and formation types with certain tools and drilling parameters. The offset data may, for example, identify torque interactions between rock-types and drill bits, drill bit speed limits for certain types of formations, etc. The offset data may be characterized by the rock-types corresponding to the data, and associated with those rock-types within the model 300. Accordingly, the operating constraints determined using both the earth model 300 and an offset data set may be strata-specific, with each strata associated with a different operating constraint or set of operating constraints.

FIG. 3 further illustrates a well plan 350 within the formation 300. The well plan 350 may comprise the planned trajectory of a well drilled into the formation 300. The model 300 may be used to identify where and when the well will intersect the boundaries 304-308, where and when the well will encounter certain types of rock formations in the strata 302*a-d*, the downhole drilling parameters expected when a drilling assembly following the well plan 350 is in contact with the strata 302*a-d*, and the operating constraints to use when outputting control signals. When a well is being drilled according to the well plan 350, a control unit may select the operating constraint or set of operating constraints associated with the formation strata in which the drilling assembly is positioned according to the earth model 300 and well plan 350, and may use the selected set of operating constraints to generate and output the control signals to elements of the drilling assembly. Additionally, the control unit may use input data from the drilling assembly to determine when a boundary has been crossed to different strata in the earth model 300, and may select the operating constraint or set of operating constraints associated with the different strata. The control unit may also use the input data to verify the earth model 300 and to update the earth model 300 and the operating constraints if the earth model 300 is incorrect.

Figure 4:
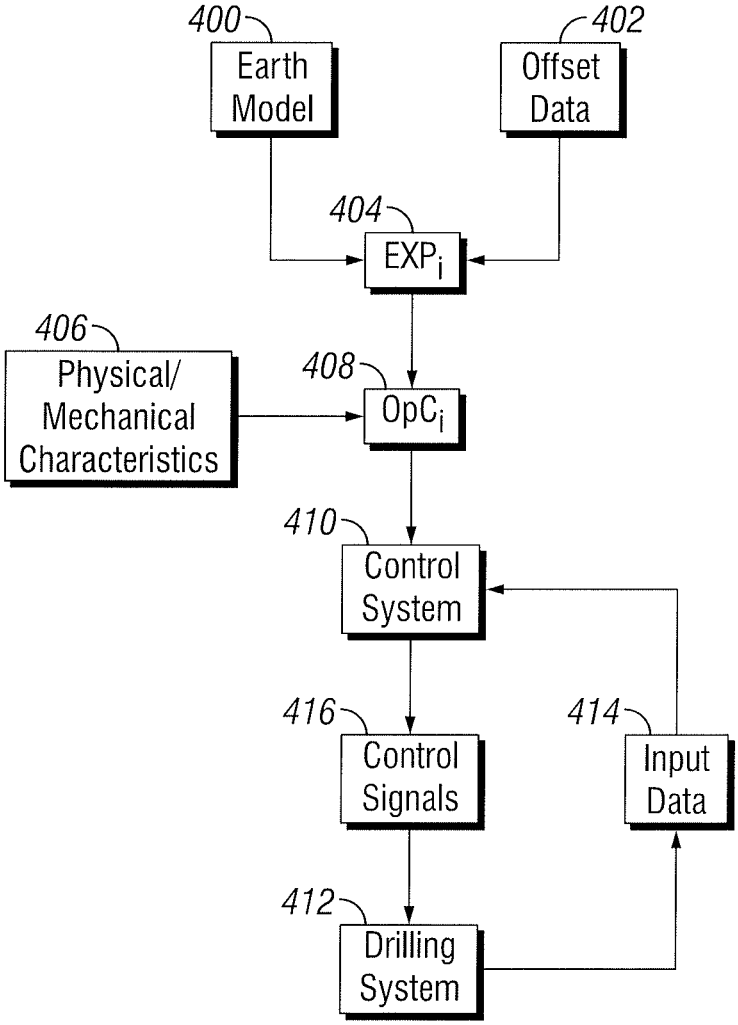
FIG. 4 is a diagram of an example process for generating operating constraints and outputting control signals, according to aspects of the present disclosure.

FIG. 4 is a diagram of an example process for generating operating constraints and outputting control signals based, at least in part, on the operating constraints, according to aspects of the present disclosure. The process may be implemented in an information handling system or control unit, as described above. In the embodiment shown, an earth model 400 and a set of offset data 402 may be received at a processor, which may generate a set of expected measurement values 404 based, at least in part, on the earth model 400 and the offset data 402. The set of expected measurement values 404 may include subsets that are associated with the different formation strata identified in the earth model 400. In the embodiment shown, the set of expected measurement values 404 is expressed as $EXP_i$ with i corresponding to one formation strata out of the formation strata in the earth model 400. The set of expected drilling parameters 404 may comprise the drilling parameters and/or downhole logging measurements that are expected within a particular formation strata based on the type of strata from the earth model 400 and the drilling parameters and/or downhole logging measurements found in similar strata from the offset data 402.

In certain embodiments, a processor may receive the set of expected measurement values 404 and at least one physical, mechanical, or operational limit 406 of the drilling assembly, and may generate a set of operating constrains 408 based at least in part on the set of expected drilling parameter values 404 and at least one physical, mechanical, or operational limit 406 of the drilling assembly. The at least one physical, mechanical, or operational characteristic 406 of the drilling assembly may comprise limits outside of which the drilling assembly or an element of the drilling assembly will not function as intended. These limits may be based on the mechanical limits of the drilling assembly, for example, the strength of downhole bearings, the tensile strength of downhole tools, etc. The limits may also be based on the interactions between different elements of the drilling assembly. For example, as will be described below, a particular steering assembly may only be able to maintain the drilling direction of the drilling assembly when certain torque and rotation parameters or met with respect to the power available to the steering assembly.

The set of operating constraints 408 may be generated or calculated by the processor and may reflect a range of drilling parameters or a range of values related to the drilling parameters of the drilling assembly that will ensure that the drilling assembly functions as intended and/or functions in an optimized manner. Like the set of expected drilling parameter values 404, the set of operating constraints 408 may include subsets that are associated with the different formation strata identified in the earth model 400, with the operating constraints 408 in FIG. 4 indicated as $OpC_i$ and i corresponding to one formation strata out of the formation strata in the earth model 400. In certain embodiments, the operating constraints 408 may be multi-dimensional with respect to the drilling parameters for a drilling assembly. Specifically, the operating constraints 408 may comprise a two or more dimensional envelope which limits combinations of two or more drilling parameters.

In certain embodiments, the set of operating constraints 408 may be used by a control system or algorithm 410 to control the drilling system 412. Specifically, the control system 410 may receive input data 414 from elements of the drilling system 412 and may selectively output control signals 416 to the drilling system 412 based, at least in part, on a comparison between the input data 414 and the set of operating constraints 408. In certain embodiments, the control system 410 may automatically generate control signals 416 to the drilling system 412 without operator involvement.

Additionally, in certain embodiments, the control system 410 may use the input data 414 to update the earth model 400 for the formation or to monitor the operating conditions of the drilling assembly.

Figure 5:
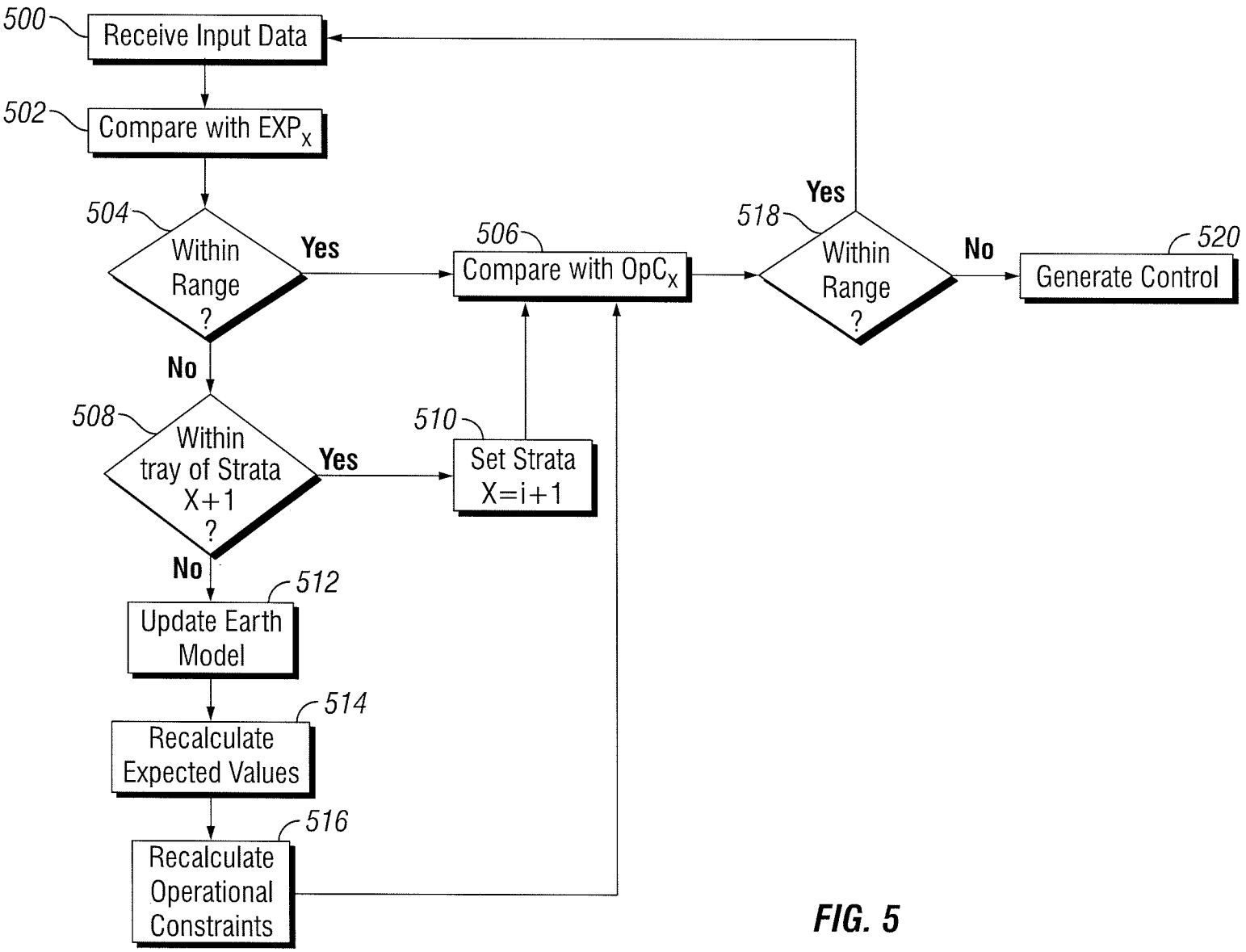
FIG. 5 is a diagram of an example control system process, according to aspects of the present disclosure.

FIG. 5 is a diagram of an example control system process, according to aspects of the present disclosure. For explanatory purposes, the process below may comprise a current formation variable x which may be set to values corresponding to one or more formation strata i, i+1, i+2, etc. The current formation variable x may be set to i initially, with i corresponding to the formation strata closest to the surface. Step 500 may comprise receiving input data from at least one element of a drilling system. As described above, the input data may comprise measurement or logging information from a BHA that may include direct or indirect measurements of drilling parameters of the drilling assembly. At step 502, the input data may be compared directly to a set of expected measurement values associated with a current formation strata x, $EXP_x$, or the input data may be compared to $EXP_x$ after the input data is processed.

At step 504 it is determined whether the input data is within a range of the set expected measurement values $EXP_x$. If the input data is in range of the set expected measurement values $EXP_x$, the input data may be compared to a set of operating constraints associated with the current formation strata x, $OpC_x$, at step 506. If the input data is not in range of the set expected measurement values $EXP_x$, it may indicate that an earth model used to determine the set expected measurement values $EXP_x$ is incorrect, or the depth of the drilling assembly is not precisely known with respect to the earth model, and the process may move to step 508. Step 508 may comprise determining if the input data is in range of the set of expected measurement values associated with the next formation strata i+1. This may happen, for example, when the boundary to the next formation strata i+1 is reached, and one or more drilling parameters or downhole measurements reflects conditions within the next formation strata x+1. If the input data is in range of the set of expected measurement values associated with the next formation strata x+1, the current formation strata variable x may be set to i+1 at step 510, so that the correct set of operating constraints may be selected for comparison at step 506. If the input data is not in range of the expected drilling parameters for the formation strata i+1, the earth model may be updated at step 512 and the set expected measurement values and operating constraints for strata i may be recalculated at steps 514 and 516, respectively.

Step 518 may comprise determining whether the input data is within range of the set of operating constraints associated with the current formation strata x, $OpC_x$. If the input data is within range, then the drilling assembly may be operating within the set of operating constraints $OpC_x$, and the process may return to step 500, where new input data is received. If the input data is not within range, the controller or processor may generate one or more control signals at step 520. As described above, the control signals may cause one or more elements of the drilling assembly to alter a drilling parameter of the system so that the drilling assembly operates within the operating constraints.

In other embodiments, the processor or control system further may monitor changes in one or more drilling parameters over time using the input data. Changes in drilling parameters within one formation strata may indicate, for example, a mechanical condition of the tool. In one embodiment, the control system may receive input data from the drilling system and determine the TOB each time input data is received. If the TOB changes over time with an identifiable gradient, or changes sharply when a formation boundary is not present, it may indicate that a mechanical failure has occurred in one or more elements of the drilling assembly, and the drilling operating may be halted so that maintenance operations can be performed.

The control system and process described above may be used with different elements and systems of a drilling assembly. In one embodiment, the control system described above may be used with a steering assembly similar to the one described above with respect to FIG. 1 to ensure that the steering assembly accurately maintains a selected drilling direction. Some steering assemblies use downhole power sources (e.g., electric motors, fluid flow, etc.) to maintain the drilling direction of the drill bit while the drill bit engages with a formation. The available power at the power source may impose limits on the steering assembly with regard to the drilling parameters that can be accommodated and adjusted for to maintain the drilling direction. For example, in a point-the-bit rotary steerable application, a steering assembly may utilize a counter-rotating force to counteract the torque and rotation applied to the drill bit by the drill string in order to maintain the desired angular orientation of the drill bit with respect to the formation. If the torque and rotation rate are kept within a particular range defined by the operating constraints for the steering assembly, the steering assembly may have sufficient power to compensate for the torque and rotation to maintain the drilling direction. If the torque and rotation rate exceed that range, the steering assembly may not have sufficient power to compensate for the torque forces and the drilling direction may change.

Figure 6:
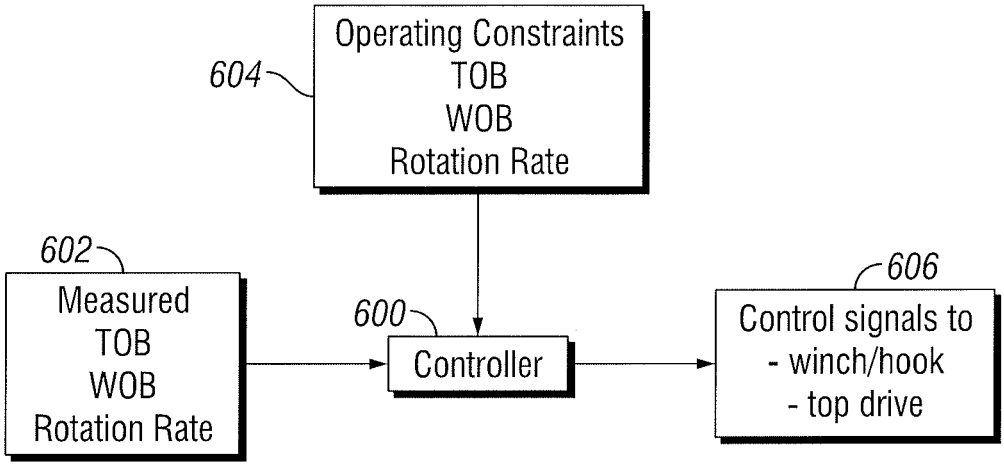
FIG. 6 is an example diagram of a control system for a steering assembly, according to aspects of the present disclosure.

FIG. 6 is an example diagram of a control system for a steering assembly, according to aspects of the present disclosure. As described above, the system may comprise a controller or control unit 600 that receives input data corresponding to drilling parameters. In the embodiment shown, the input data 602 comprises direct measurements for TOB, WOB, and rotation rate from one or more sensors at or near the steering assembly. The TOB, WOB, and rotation rate measurements may be communicated to the controller 600, which may be located, for example at the surface or downhole within a BHA. The controller 600 may also receive operating constraints for the TOB, WOB, and rotation rate drilling parameters that may be calculated based, at least in part, on the operational capabilities of the steering assembly. If one or more of the measured TOB, WOB, and rotation rate exceed the operating constraint 604, the controller 600 may generate control signals 606 to one or more elements of the drilling system to cause the elements to alter one of the drilling parameters. For example, the controller 600 may generate a control signal to the winch/hook assembly at the surface to decrease the WOB downhole and/or a control signal to the top drive to change the torque and rotation rate applied to the drill string. As will be described below, the controller 600 may also actuate a downhole mechanism for varying the TOB or WOB.

In many instances, the drill string to which the steering assembly is attached may be thousands of feet long, and torque applied to the drill string at the surface may cause the drill string to wind. Depending on the number of winds in the drill string, the drilling assembly may encounter "stick-slip" operations, where the steering assembly and drill bit temporarily stop rotating "stick" before abruptly starting again "slip." This abrupt start may cause torque conditions on the drill bit, which may exceed the limits of the steering assembly.

In certain embodiments, to account for the stick-slip conditions, the input data 602 may include measurements from which the number of winds in a drill string can be calculated, and the operating constraints 604 may comprise limits on the number of acceptable winds to avoid stick-slip conditions. Specifically, the input data 602 may include tool face angle measurements from at least one tool face sensor attached downhole at or near the BHA and at the surface and at least one tool face sensor attached to a portion of the drill string at or near the surface. By comparing the tool face angle of the steering assembly with the tool face angle of the drill string at the surface, the number of winds in the drill string can be calculated by the controller 600. The controller 600 may then compare the calculated number of winds with the operating constraint and, if the number of winds is outside of the operating constraint, the controller 600 may generate one or more control signals to alter drilling parameters that will affect the number of winds. For example, the controller 600 may issue a control signal to change the WOB, TOB, and/or rotation rate, all of which may alter the number of winds in the drill string.

Figure 7:
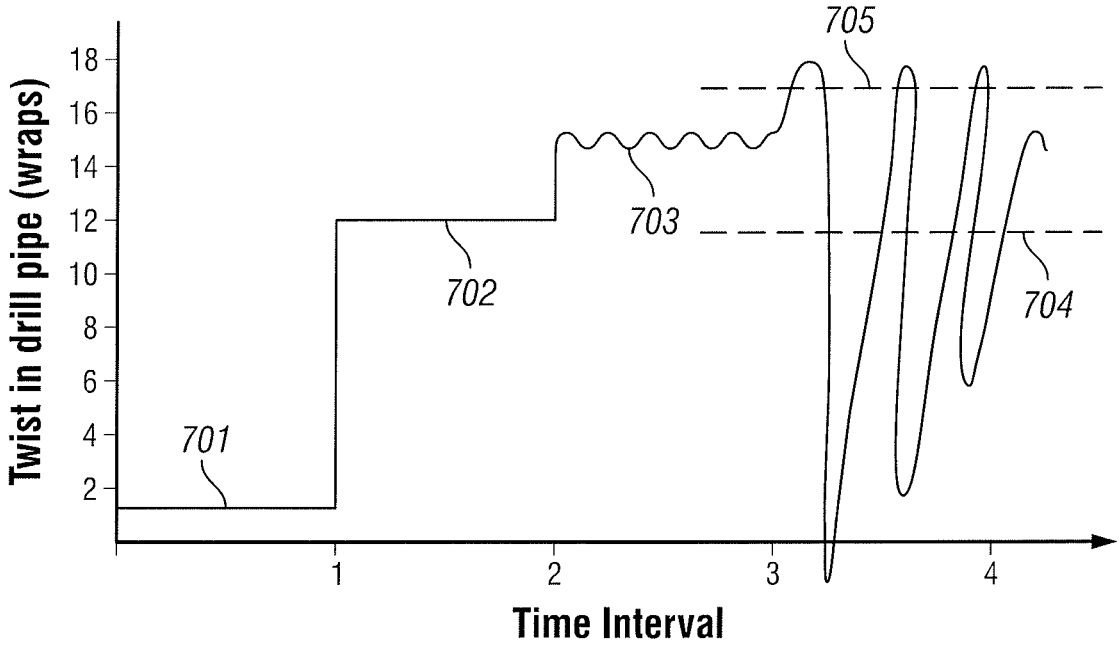
FIG. 7 is a chart illustrating an example operating constraint corresponding to the winds in a drill string, according to aspects of the present disclosure.

FIG. 7 is a chart illustrating an example operating constraint corresponding to the winds in a drill string, according to aspects of the present disclosure. Chart 700 plots the number of winds of the drill string on the x-axis with time on the y-axis, and illustrates the potential number of winds per different usage conditions. Portion 701 of the chart 700 reflects a usage condition where the drill string is not rotating, in which case the number of winds in the drill string may be at or near zero. Portion 702 reflects a situation where the drill string is rotating but the drill bit is not engaging the formation. Portion 703 reflects a situation where the drill string is rotating and the drill bit is engaging the formation, but the number of winds is kept within the operating constraints 704. Although the number of windings may oscillate in portion 703, the resulting torque conditions at the drill bit and steering assembly may remain substantially constant within the operating limits of the steering assembly. In contrast, portion 705 reflects a portion when the number of windings is outside of the operating constraints 705, leading to stick-slip conditions in which the number of windings and the torque conditions at the steering assembly and drill bit change drastically and exceed the limits of the steering assembly.

In addition to using the control system to maintain an element of a drilling assembly within operating limits, the control system may also be used to optimize aspects of the drilling system. For example, the control system may be used with respect to a drill bit and BHA to optimize the rate of penetration of the drilling assembly and to protect downhole elements. As a drilling assembly drills through a formation, the axial and torque forces applied to the drill bit may cause the drill bit to move about the borehole in a whirl pattern, contacting the formation in different locations at the end of the borehole over time. This drill bit whirl decreases the rate of penetration of the drilling assembly because of the inconsistent contact point with the formation. The drill bit whirl may also cause lateral vibration within the BHA above the drill bit, which may damage sensitive mechanical and electrical elements.

Figure 8:
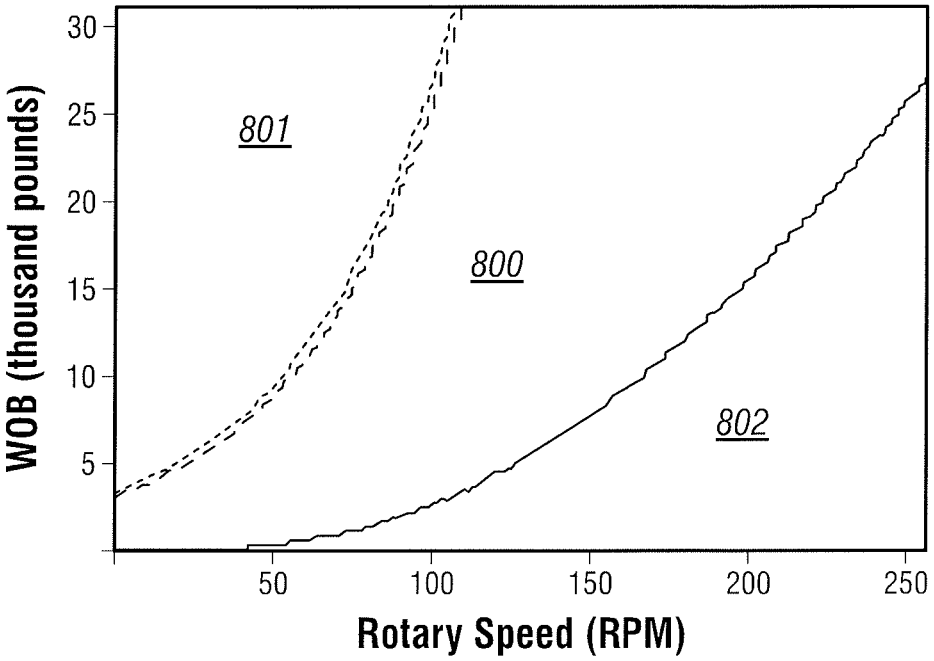
FIG. 8 is a chart illustrating an example operating constraint to avoid drill bit whirl, according to aspects of the present disclosure.

According to aspects of the present disclosure, operating constraints for one or more drilling parameters may be selected to reduce the drill bit whirl and a control system similar to the control systems described above may output control signals to ensure that the drilling assembly stays within the operating constraints. With respect to drill bit whirl, the operating constraints may comprise two-dimensional operating constraints in terms of WOB and rotation rate, which identifies the combinations of WOB values and rotation rates in which drill bit whirl and lateral vibration is minimized. FIG. 8 is a chart illustrating a stable operating region 800 in between two unstable regions 801 and 802, plotted in terms of WOB on the x-axis and rotary speed in RPM on the y-axis. Notably, not all drill bits, borehole conditions, and formation types will have the same stable and unstable ones, or such a distinctly stable operating zone, but similar operating constraints may be calculated using the known drill bits, borehole conditions, and formation types for a given drilling operating. When a particular combination of the measured WOB and rotary speed drilling parameters falls outside of the stable region 800, a controller may issue control signals to alter one or both of the WOB and rotary speed drilling parameters until the system returns to the stable region 800.

Although the systems above are described with respect to drilling system elements (e.g., hook assembly, pump, top drive, etc.) positioned at the surface and the modification or alteration of drilling parameters by issuing control signals to the surface drilling system elements, the control system may also be implemented in a closed loop system downhole, in which downhole elements receive control signals from a downhole controller and alter drilling parameters in response to the control signals. The control systems may also be split between surface-level and downhole elements, where some drilling parameters are adjusted at the surface and some downhole. In yet other embodiments, certain drilling parameters may be adjusted both at the surface and downhole.

Figure 9:
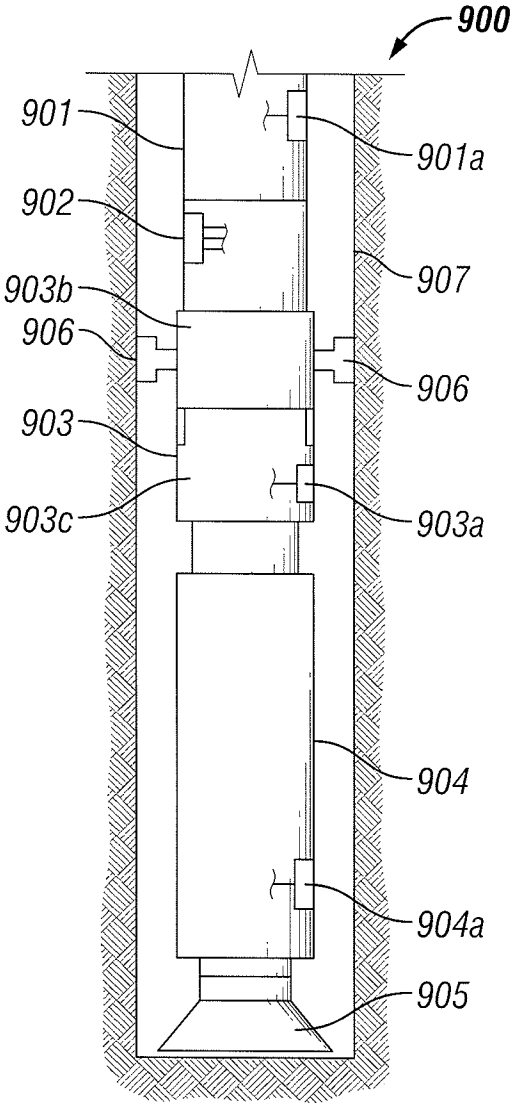
FIG. 9 is a diagram of an example downhole tool capable of altering one or more drilling parameters, according to aspects of the present disclosure.

FIG. 9 is a diagram of an example BHA capable of altering one or more drilling parameters, according to aspects of the present disclosure. In the embodiment shown, the BHA 900 comprises a LWD/MWD section 901, a controller 902, a thrust control unit 903, a downhole motor 904, and a drill bit 905. The controller 902 may be communicably coupled to controllers and/or measurements devices 901*a*, 903*a*, and 904*a* of the LWD/MWD section 901, thrust control unit (TCU) 903, and downhole motor 904, respectively. Some of all of the controllers and/or measurements devices 901*a*, 903*a*, and 904*a* may communicate as input data measured drilling parameters to the controller 902. For example, the controller and/or measurements device 901*a* of the LWD/MWD section 901 may measure a tool face angle of the BHA 900, the controller and/or measurements device 903*a* of the TCU 903 may measure the WOB, and the controller and/or measurements device 904*a* of the downhole motor 904 may measure the TOB and rotation rate of the drill bit 904. The controller 902 may function similar to the control systems described above, and may compare the received input data to one or more operating constraints for the drilling assembly. The operating constraints may be stored downhole within the controller 902 in a separate storage medium or within memory integrate within the controller 902. The controller 902 may then generate control signals to one or more of the controllers and/or measurements devices 901*a*, 903*a*, and 904*a* of the LWD/MWD section 901, TCU 903, and downhole motor 904, to alter one or more drilling parameters.

In the embodiment shown, the downhole motor 904 is responsible for driving the drill bit 905, and therefore may control the torque applied to the drill bit 904 and the rotation rate of the drill bit 904. The downhole motor 904 may comprise, for example, an electric motor, a mud motor, or a positive displacement motor. In the case that the downhole motor 904 comprises an electric motor, the torque and rotation rate of the drill bit 905 may be altered by varying the level or the power driving the motor 904. In the case that the downhole motor 904 comprises a mud motor or positive displacement motor, the torque and rotation rate applied to the drill bit 905 may depend, in part, on the flow rate of drilling fluid through the downhole motor 904. Accordingly, the torque and rotation rate applied to the drill bit by including one or more bypass valves that may divert a portion of the drilling fluid either into an annulus surrounding the downhole motor 904 or through the downhole motor 904 without contributing to the rotation of the drill bit 905. In instances, the controller and/or measurement device 904*a* may transmit signals to one or more electric components (e.g., bypass valves or electric motors) of the downhole motor 904 to alter the TOB and rotation rate of the drill bit 905.

In certain embodiments, the thrust control unit 903 may be used to alter the WOB. In the embodiment shown, the TCU 903 comprises extendable arms 906 that contact a wall of the borehole 907. The extendable arms 906 may be powered by a clean oil system and pump (not shown) within the TCU 903, or may be powered using drilling mud flowing through the BHA 900. The TCU 903 may comprise an anchor section 903*b* from to which the extendable arms 906 are coupled and a thrust section 903*c* to which the anchor section may impose an axial force. Like the extendable arms 906, the axial force may be provided by a clean oil system and pump located in the TCU 903.

The thrust section 903*c* may be coupled to the downhole motor 904 and the axial force imparted on the thrust section 903*c* by the anchor section may be transferred to the downhole motor 904 and drill bit 905. Accordingly, the WOB may be altered by changing the axial force imparted on the thrust section 903*c*. As drilling progresses, the extendable arms 906 may be wholly or partially retracted, disengaging with the wall of the borehole 907, and allowing the arms 906 to be extended and reset at a lower position on the borehole 906 to maintain a constant WOB. Like the downhole motor 904, the controller and/or measurement device 903*a* of the TCU 903 may transmit signals to one or more components (e.g., pumps and valves) of the TCU 903 to alter the WOB when prompted by a control signal from the controller 902.

In an alternative embodiment, the thrust section 903 may comprise extendable arms each with one or more tracks that grip the wall of the borehole 907. The tracks may comprise tank-like tracks with continuously rotatable treads. Instead of using extendable arms that anchor against the wall of the borehole 907 and separate anchor and thrust sections 903*b* and 903*c*, the tracks may apply a constant downward axial force on the drill bit 905 without having to be retracted and reset. Other embodiments would be appreciated by one of ordinary skill in the art in view of this disclosure. For example, the WOB could also be varied through control of a piston attached to the drill string, such as on the Reelwell™ system, that interacts with the liner or casing to create a piston thrust force on the drill string through surface hydraulics.

To aid the TCU 903, real-time or recorded data from previous measurements either in the current well or in offset wells can be used to determine mechanical properties of the formation such as a compressive strength and stress profile of the wall of the borehole 907. An earth model stored in the system can be updated based on localized measurements at or near the TCU 903 to refine the existing model and thereby improve the prediction of the formation characteristics. For example, if the distance of extension of the extendable arms 906 is measured by the system for a given force the spring constant of the formation can be determined and thus the compressive strength. If the overall gradient of the compressive strength is increasing or decreasing in the area of the borehole 907 at a different rate than that of the offset data from a nearby well, updating the earth model will aid in refining the optimal weight required with a given bit and the drill bit's current sharpness to determine what the WOB limits should be for drilling.

Figure 10:
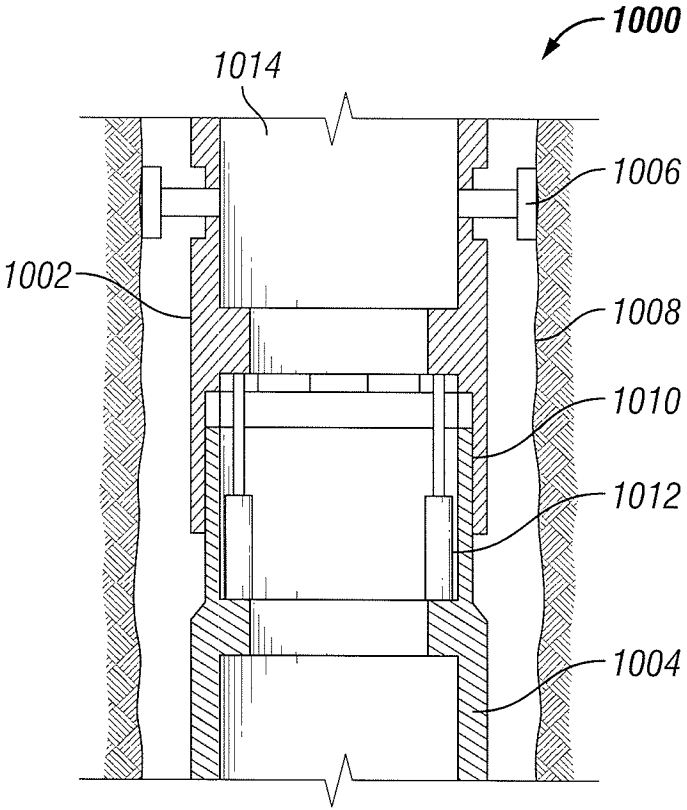
FIG. 10 is a diagram of an example thrust control unit, according to aspects of the present disclosure.

FIG. 10 is a diagram of an example TCU 1000, according to aspects of the present disclosure. As can be seen, the TCU 1000 comprises an anchor portion 1002 and a thrust portion 1004. One or more extendable arms 1006 may be coupled to the anchor portion 1002, and may engage with the borehole wall 1008. In the embodiment shown, the thrust portion 1004 is coupled to the anchor portion 1002 through spline 1010 and rams 1012. The spline 1010 may keep the thrust portion 1004 axially aligned within the anchor portion 1002, and the rams 1012 may be used to impart a downward axial force on the thrust portion 1004. Notably, the rams 1012 may be bi-directional with a long stroke length and quick response time for fine control of the WOB. In certain embodiments, a drill string may rotate within the bore 1014 of the TCU 1000, allowing the TCU 1000 to be used when a drill bit is rotated from the surface via a top drive.

Figure 11:
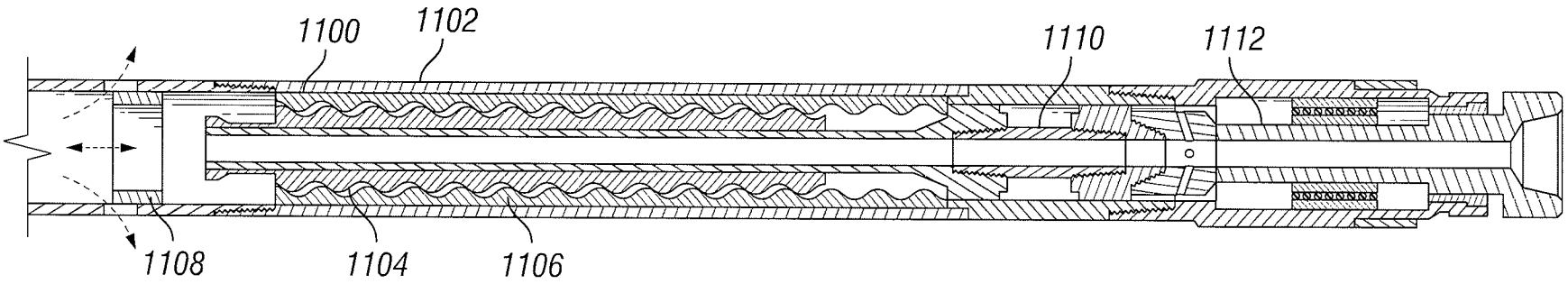
FIG. 11 is a diagram of an example downhole motor, according to aspects of the present disclosure.

FIG. 11 is a diagram of an example downhole motor 1100, according to aspects of the present disclosure. The motor 1100 may comprise a positive displacement motor an outer housing 1102 that may be coupled to other elements of a BHA. In certain embodiments the motor 1100 may comprise a rotor 1104 and a stator 1106, with the rotor being coupled to a drill bit and driving the drill bit in response to a flow of drilling fluid through the motor 1100. In the embodiment shown, the motor comprises a bypass valve 1108 which may be opened to divert drilling fluid away from the rotor 1104, outside of the motor 1100. In an alternative embodiment, the valve may divert fluid through the rotor 1104 such that it avoids the interface between the rotor 1104 and the stator 1106.

The flow of drilling fluid across the rotor 1104 and stator 1106 may create a differential pressure that creates a downward axial force on the rotor 1104, which may be transmitted from the rotor 1104 to the CV shaft 1110 and the bearing section shaft 1112 to a drill bit (not shown). Rather than transmitting this axial force to the housing 1102, as is typical with downhole motors, the bearing section may allow the rotor 1104 to move with respect to the stator 1106 and apply the axial force to the bit. Accordingly, the TOB, WOB, and rotation rate of the drill bit may be altered by controlling the bypass valve 1108.

According to aspects of the present disclosure, an example method for control of a drilling assembly may include receiving measurement data from at least one sensor coupled to an element of the drilling assembly positioned in a formation. An operating constraint for at least a portion of the drilling assembly may be determined based, at least in part, on a model of the formation and a set of offset data. A control signal may be generated to alter one or more drilling parameters of the drilling assembly based, at least in part, on the measurement data and the operating constraint. The control signal may be transmitted to a controllable element of the drilling assembly.

In certain embodiments, generating the control signal to alter one or more drilling parameters may comprise generating a control signal to alter one or more of a weight-on-bit (WOB) parameter, a torque-on-bit (TOB) parameter, a rotation rate of a drill bit, a drilling fluid flow rate, and a tool face angle of the element of the drilling assembly. Receiving measurement data from the at least one sensor may comprise receiving a first tool face angle measurement of a steering assembly; determining the operating constraint for at least the portion of the drilling assembly may comprise determining upper and lower limits on the number of winds in a drill string of the drilling assembly; and generating the control signal to alter one or more drilling parameters of the drilling assembly may comprise determining a current number of winds based on the first tool face angle and a second tool face angle of a portion of the drill string near the surface, and generating a control signal to alter one or more of the TOB, WOB, and rotation rate of the drill bit if the current number of winds falls outside of the upper and lower limits.

In certain embodiments, receiving measurement data from the at least one sensor may comprise receiving a WOB measurement and a TOB measurement; determining the operating constraint for at least a portion of the drilling assembly may comprise determining combinations of WOB and TOB drilling parameters for the drilling assembly that minimize drill bit whirl; and generating the control signal to alter one or more drilling parameters of the drilling assembly may comprise generating the control signal to alter one or more of the TOB and WOB drilling parameters so that the altered TOB and WOB drilling parameters comprise one of the combinations of WOB and TOB drilling parameters that minimize drill bit whirl. In any one of the embodiments described above, transmitting the control signal to the controllable element of the drilling assembly may comprise transmitting the control signal to at least one of a controllable element of the drilling assembly positioned at a surface of the formation and a controllable element of the drilling assembly positioned in the formation.

In certain embodiments, the controllable element of the drilling assembly positioned at the surface may comprise at least one of a hook assembly, a pump, and a top drive. In certain embodiments, the controllable element of the drilling assembly positioned in the formation may comprise at least one of a downhole motor and a thrust control unit. In those embodiments, the downhole motor may comprise a positive displacement mud motor, and the thrust control unit may comprise at least one extendable arm to anchor the thrust control unit against the formation.

In any one of the embodiments described above, the example method may further comprise updating the model using the received measurement data if the received measurement data is not within a set of expected measurement data generated from the model and the set of offset data, and determining new operating constraints based, at least in part, on the updated model. Likewise, in any one of the embodiments described above, the example method may further comprise determining at least one drilling parameter of the drilling assembly based on the received measurement data, and identifying a fault in one or more elements of the drilling assembly based, at least in part, on the determined drilling parameter.

According to aspects of the present disclosure, an example system for control of a drilling assembly may comprise a sensor within a borehole in a formation, a controllable element, and a processor communicably coupled to the sensor and the controllable element. The processor may be coupled to a memory device containing a set of instructions that, when executed by the processor, causes the processor to receive measurement data from the sensor; determine an operating constraint for the drilling assembly based, at least in part, on a model of the formation and a set of offset data; generate a control signal to alter one or more drilling parameters of the drilling assembly based, at least in part, on the measurement data and the operating constraint; and transmit a control signal to the controllable element.

In certain embodiments, one or more drilling parameters may comprise at least one of a weight-on-bit (WOB) parameter, a torque-on-bit (TOB) parameter, a rotation rate of a drill bit, a drilling fluid flow rate, and a tool face angle of the element of the drilling assembly. In any of the embodiments described above, the processor and the controllable element may be at least partially within the borehole, and the controllable element may comprise at least one of a downhole motor and a thrust control unit. In certain embodiments, the downhole motor may comprise a positive displacement mud motor, and the thrust control unit may comprise at least one extendable arm to anchor the trust control unit against the formation.

In certain of the above embodiments, the processor is positioned at a surface of the formation, and the controllable element comprises at least one of a hook assembly, a pump, and a top drive. The controllable element may be positioned at a surface of the formation; the processor may be located at either a surface of the formation or within the borehole; and the set of instructions that causes the processor to transmit the control signal to the controllable element further may cause the processor to transmit a first control signal to the controllable element, and transmit a second control signal to a second controllable element within the borehole. In certain embodiments, the measurement data may comprise a first tool face angle measurement of a steering assembly to which the sensor is coupled; the operating constraint may comprise upper and lower limits on the number of winds in a drill string of the drilling assembly; and the set of instructions that cause the processor to generate the control signal further may cause the processor to determine a current number of winds based on the first tool face angle and a second tool face angle of a portion of the drill string near the surface, and generate the control signal to alter one or more of the TOB, WOB, and rotation rate of the drill bit if the current number of winds falls outside of the upper and lower limits.

In certain embodiments, the measurement data may comprise a WOB measurement and a TOB measurement; the operating constraint may comprise combinations of WOB and TOB drilling parameters for the drilling assembly that minimize drill bit whirl; and the set of instructions that cause the processor to generate the control signal further may cause the processor to generate the control signal to alter one or more of the TOB and WOB drilling parameters so that the altered TOB and WOB drilling parameters comprise one of the combinations of WOB and TOB drilling parameters that minimize drill bit whirl. In certain embodiments, the set of instructions further may cause the processor to update the model using the received measurement data if the received measurement data is not within a set of expected measurement data generated from the model and the set of offset data, and determine new operating constraints based, at least in part, on the updated model. Similarly, in certain embodiments, the set of instructions further may cause the processor to determine at least one drilling parameter of the drilling assembly based on the received measurement data; and identify a fault in one or more elements of the drilling assembly based, at least in part, on the determined drilling parameter.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that it introduces.

What is claimed is:

1. A method for control of a drilling assembly, comprising:

receiving measurement data from at least one sensor coupled to an element of the drilling assembly positioned in a formation;

determining a set of operating constraints for at least a portion of the drilling assembly based, at least in part, on a model of the formation and a set of offset data, wherein the offset data comprises actual data recorded from at least one drilling operation that correlates at least one of one or more rock types and one or more formation types with one or more drilling parameters, wherein the model identifies location of a boundary, the one or more rock types and one or more orientations of a plurality of strata of the formation, wherein:

the formation comprises a first strata and a second strata of the plurality of strata;

the first strata is associated with a first subset of operating constraints from the set of operating constraints;

the second strata is associated with a second subset of operating constraints from the set of operating constraints;

the first subset of operating constraints comprises a first range of values relating to the one or more drilling parameters;

the second subset of operating constraints comprises a second range of values relating to the one or more drilling parameters; and the first range of values is different from the second range of values;

determining that the drilling assembly is positioned in the first strata of the formation;

in response to determining that the drilling assembly is in the first strata of the formation, generating a first control signal to alter the one or more drilling parameters of the drilling assembly based, at least in part, on the measurement data and the first subset of operating constraints;

transmitting the first control signal to a controllable element of the drilling assembly;

determining that the drilling assembly has crossed in to the second strata of the formation;

in response to determining that the drilling assembly has crossed in to the second strata of the formation, generating a second control signal to alter the one or more drilling parameters of the drilling assembly based, at least in part, on the measurement data and the second subset of operating constraints; and transmitting the second control signal to the controllable element of the drilling assembly.

2. The method of claim 1, wherein generating at least one of the first control signal or the second control signal to alter one or more drilling parameters comprises generating a control signal to alter one or more of a weight-on-bit (WOB) parameter, a torque-on-bit (TOB) parameter, a rotation rate of a drill bit, a drilling fluid flow rate, and a tool face angle of the element of the drilling assembly.

3. The method of claim 2, wherein receiving measurement data from the at least one sensor comprises receiving a first tool face angle measurement of a steering assembly;

determining the set of operating constraints for at least a portion of the drilling assembly comprises determining upper and lower limits on the number of winds in a drill string of the drilling assembly; and generating the control signal to alter one or more drilling parameters of the drilling assembly comprises determining a current number of winds based on the first tool face angle and a second tool face angle of a portion of the drill string near the surface; and generating a control signal to alter one or more of the TOB, WOB, and rotation rate of the drill bit if the current number of winds falls outside of the upper and lower limits.

4. The method of claim 2, wherein receiving measurement data from the at least one sensor comprises receiving a WOB measurement and a TOB measurement;

determining the set of operating constraints for at least a portion of the drilling assembly comprises determining combinations of WOB and TOB drilling parameters for the drilling assembly that minimize drill bit whirl; and generating the control signal to alter one or more drilling parameters of the drilling assembly comprises generating the control signal to alter one or more of the TOB and WOB drilling parameters so that the altered TOB and WOB drilling parameters comprise one of the combinations of WOB and TOB drilling parameters that minimize drill bit whirl.

5. The method of claim 1, wherein transmitting at least one of the first control signal or the second control signal to the controllable element of the drilling assembly comprises transmitting the at least one of the first control signal or the second control signal to at least one of a controllable element of the drilling assembly positioned at a surface of the formation and a controllable element of the drilling assembly positioned in the formation.

6. The method of claim 5, wherein the controllable element of the drilling assembly positioned at the surface comprises at least one of a hook assembly, a pump, and a top drive.

7. The method of claim 5, wherein the controllable element of the drilling assembly positioned in the formation comprises at least one of a downhole motor and a thrust control unit.

8. The method of claim 7, wherein the downhole motor comprises a positive displacement mud motor; and the thrust control unit comprises at least one extendable arm to anchor the thrust control unit against the formation.

9. The method of claim 1, further comprising updating the model using the received measurement data if the received measurement data is not within a set of expected measurement data for a particular formation strata generated from the model and the set of offset data; and determining new set of operating constraints based, at least in part, on the updated model.

10. The method of claim 1, further comprising determining at least one drilling parameter of the drilling assembly based on the received measurement data; and identifying a fault in one or more elements of the drilling assembly based, at least in part, on the determined drilling parameter.

11. A system for control of a drilling assembly, comprising:

a sensor within a borehole in a formation;

a controllable element; and a processor communicably coupled to the sensor and the controllable element, the processor coupled to a memory device containing a set of instructions that, when executed by the processor, causes the processor to receive measurement data from the sensor;

determine a set of operating constraints for the drilling assembly based, at least in part, on a model of the formation and a set of offset data, wherein the offset data comprises actual data recorded from at least one drilling operation that correlates at least one of one or more rock types and one or more formation types with one or more drilling parameters, wherein the model identifies location of a boundary, the one or more rock types and one or more orientations of a plurality of strata of the formation, wherein:

the formation comprises a first strata and a second strata of the plurality of strata;

the first strata is associated with a first subset of operating constraints from the set of operating constraints;

the second strata is associated with a second subset of operating constraints from the set of operating constraints;

the first subset of operating constraints comprises a first range of values relating to the one or more drilling parameters;

the second subset of operating constraints comprises a second range of values relating to the one or more drilling parameters; and the first range of values is different from the second range of values;

determine that the drilling assembly is positioned in the first strata of the formation;

in response to determining that the drilling assembly is in the first strata of the formation, generate a first control signal to alter the one or more drilling parameters of the drilling assembly based, at least in part, on the measurement data and the first subset of operating constraint of the set of operating constraints;

transmit the first control signal to the controllable element;

determining that the drilling assembly has crossed in to the second strata of the formation;

in response to determining that the drilling assembly has crossed in to the second strata of the formation, generate a second control signal to alter the one or more drilling parameters of the drilling assembly based, at least in part, on the measurement data and the second subset of operating constraints; and transmit the second control signal to the controllable element of the drilling assembly.

12. The system of claim 11, wherein the one or more drilling parameters comprises at least one of a weight-on-bit (WOB) parameter, a torque-on-bit (TOB) parameter, a rotation rate of a drill bit, a drilling fluid flow rate, and a tool face angle of the element of the drilling assembly.

13. The system of claim 11, wherein the processor and the controllable element are at least partially within the borehole; and the controllable element comprises at least one of a downhole motor and a thrust control unit.

14. The system of claim 13, wherein the downhole motor comprises a positive displacement mud motor;

the thrust control unit comprises at least one extendable arm to anchor the trust control unit against the formation.

15. The system of claim 11, wherein the processor is positioned at a surface of the formation; and the controllable element comprises at least one of a hook assembly, a pump, and a top drive.

16. The system of claim 11, wherein the controllable element is positioned at a surface of the formation;

the processor is located at either a surface of the formation or within the borehole; and the set of instructions that causes the processor to transmit each of the first control signal and the second control signal to the controllable element further causes the processor to transmit a third control signal to the controllable element; and transmit a fourth control signal to a second controllable element within the borehole.

17. The system of claim 12, wherein the measurement data comprises a first tool face angle measurement of a steering assembly to which the sensor is coupled;

the set of operating constraints comprises upper and lower limits on the number of winds in a drill string of the drilling assembly; and the set of instructions that cause the processor to generate each of the first control signal and the second control signal further causes the processor to determine a current number of winds based on the first tool face angle and a second tool face angle of a portion of the drill string near the surface; and generate each of the first control signal and the second control signal to alter one or more of the TOB, WOB, and rotation rate of the drill bit if the current number of winds falls outside of the upper and lower limits.

18. The system of claim 12, wherein the measurement data comprises a WOB measurement and a TOB measurement;

the set of operating constraints comprises combinations of WOB and TOB drilling parameters for the drilling assembly that minimize drill bit whirl; and the set of instructions that cause the processor to generate each of the first control signal and the second control signal further causes the processor to generate each of the first control signal and the second control signal to alter one or more of the TOB and WOB drilling parameters so that the altered TOB and WOB drilling parameters comprise one of the combinations of WOB and TOB drilling parameters that minimize drill bit whirl.

19. The system of claim 11, wherein the set of instructions further causes the processor to update the model using the received measurement data if the received measurement data is not within a set of expected measurement data for a particular formation strata generated from the model and the set of offset data; and determine new set of operating constraints based, at least in part, on the updated model.

20. The system of claim 11, wherein the set of instructions further causes the processor to determine at least one drilling parameter of the drilling assembly based on the received measurement data; and identify a fault in one or more elements of the drilling assembly based, at least in part, on the determined drilling parameter.

21. The method of claim 1, further comprising:

receiving input data from one or more elements of the drilling assembly; and updating the model based on the input data.

22. The method of claim 21, further comprising:

wherein the one or more elements comprise a thrust control unit;

wherein the input data is associated with the thrust control unit;

determining a weight-on-bit based on the updated model; and wherein generating each of the first control signal and the second control signal to alter one or more drilling parameters of the drilling assembly comprises generating a control signal to the thrust control unit based on the weight-on-bit.

23. The system of claim 11, wherein the set of instructions further causes the processor to:

receive input data from one or more elements of the drilling assembly; and updating the model based on the input data.

24. The system of claim 23, wherein:

the one or more elements comprise a thrust control unit;

the input data is associated with the thrust control unit; and the set of instructions further causes the processor to:

determine a weight on bit based on the updated model; and wherein generating each of the first control signal and the second control signal to alter one or more drilling parameters of the drilling assembly comprises generating a control signal to the thrust control unit based on the weight-on-bit.

* * * * *